US006015776A

United States Patent [19]

Harrison et al.

[11] Patent Number: 6,015,776

[45] Date of Patent: Jan. 18, 2000

[54] POLYALKYLENE POLYSUCCINIMIDES AND POST-TREATED DERIVATIVES THEREOF

[75] Inventors: James J. Harrison, Novato; William R. Ruhe, Jr., Benicia, both of Calif.

[73] Assignee: Chevron Chemical Company, San Francisco, Calif.

[21] Appl. No.: 09/149,165

[22] Filed: Sep. 8, 1998

[51] Int. Cl.[7] ..... C10M 133/44; C10M 155/04

[52] U.S. Cl. ..... 508/192; 508/291; 508/293; 548/405; 548/546

[58] Field of Search ..... 508/192, 291, 508/293; 548/405, 546

[56] References Cited

U.S. PATENT DOCUMENTS

| | | | |
|---|---|---|---|
| 3,018,250 | 1/1962 | Anderson et al. | 252/51.5 |
| 3,172,892 | 3/1965 | LeSuer et al. | 260/326.5 |
| 3,219,666 | 11/1965 | Norman et al. | 260/268 |
| 3,361,673 | 1/1968 | Stuart et al. | 252/51.5 |
| 3,381,022 | 4/1968 | LeSuer | 260/404.8 |
| 3,912,764 | 10/1975 | Palmer | 260/346.8 |
| 4,234,435 | 11/1980 | Meinhardt et al. | 252/51.5 A |
| 4,612,132 | 9/1986 | Wollenberg et al. | 252/51.5 A |
| 4,747,965 | 5/1988 | Wollenberg et al. | 252/51.5 A |
| 5,112,507 | 5/1992 | Harrison | 252/51.5 A |
| 5,175,225 | 12/1992 | Ruhe | 526/272 |
| 5,241,003 | 8/1993 | Degonia | 525/123 |
| 5,286,799 | 2/1994 | Harrison et al. | 525/285 |
| 5,319,030 | 6/1994 | Harrison et al. | 525/285 |
| 5,334,321 | 8/1994 | Harrison et al. | 252/51.5 A |
| 5,356,552 | 10/1994 | Harrison et al. | 252/51.5 A |
| 5,670,462 | 9/1997 | Barr et al. | 508/291 |
| 5,716,912 | 2/1998 | Harrison et al. | 508/192 |
| 5,821,205 | 10/1998 | Harrison et al. | 508/291 |
| 5,849,676 | 12/1998 | Harrison et al. | 508/291 |
| 5,851,965 | 12/1998 | Harrison et al. | 508/291 |
| 5,853,434 | 12/1998 | Harrison et al. | 508/291 |
| 5,872,083 | 2/1999 | Harrison et al. | 508/291 |

*Primary Examiner*—Jacqueline V Howard
*Attorney, Agent, or Firm*—Richard J. Sheridan

[57] ABSTRACT

A polysuccinimide composition is prepared by reacting a mixture of an alkenyl or alkylsuccinic acid derivative, an unsaturated acidic reagent copolymer, and a polyamine under reactive conditions. The alkenyl or alkyl substituent of the alkenyl or alkylsuccinic acid derivative has a Mn of from 140 to 3000. The unsaturated acidic reagent copolymer has an average degree of polymerization of from 2 to 20, and is a copolymer of an unsaturated acidic reagent and an olefin having a Mn of at least 1000. The polyamine has at least three nitrogen atoms and has from 4 to 20 carbon atoms.

18 Claims, No Drawings

POLYALKYLENE POLYSUCCINIMIDES AND POST-TREATED DERIVATIVES THEREOF

The present invention relates to novel compositions comprising polyalkylene polysuccinimides and post-treated derivatives of polyalkylene polysuccinimides. In a further aspect, the invention relates to methods of preparing these compositions and their uses as dispersants in lubricating oils and deposit inhibitors in hydrocarbon fuels. In another aspect, the invention relates to concentrates, lubricating oil compositions, and hydrocarbon fuel compositions containing such novel compositions.

BACKGROUND OF THE INVENTION

Lubricating oil compositions for internal combustion engines generally contain a variety of additives to reduce or control deposits, wear, corrosion, etc. Similarly, liquid hydrocarbon fuels for internal composition engines, at a minimum, contain additives which control or reduce the formation of deposits. The present invention is concerned with compositions useful as dispersants or deposit inhibitors.

In lubricating oils, dispersants function to control sludge, carbon, and varnish produced primarily by the incomplete oxidation of the fuel, or impurities in the fuel, or impurities in the base oil used in the lubricating oil composition. Dispersants also control viscosity increase due to the presence of soot in diesel engine lubricating oils.

Deposit inhibitors in fuel control or reduce engine deposits also caused by incomplete combustion of the fuel. Such deposits can form on the carburetor parts, throttle bodies, fuel injectors, intake parts, and valves. Those deposits can present significant problems, including poor acceleration and stalling, and increased fuel consumption and exhaust pollutants.

One of the most effective classes of lubricating oil dispersants and fuel deposit inhibitors is polyalkylene succinimides. In some cases, the succinimides have also been found to provide fluid-modifying properties, or a so-called viscosity index credit, in lubricating oil compositions. That results in a reduction in the amount of viscosity index improver which would be otherwise have to be used. A drawback of succinimide dispersants is that they have generally been found to reduce the life of fluorocarbon elastomers. In general, for a given succinimide dispersant, a higher nitrogen content gives better dispersancy but poorer fluorocarbon elastomer compatibility.

Therefore, as well as improving the dispersancy and VI credit properties of polyalkylene succinimides, it would be desirable to improve the fluorocarbon elastomer compatibility of such dispersants. It would further be desirable to improve the stability of polyalkylene succinimides, particularly hydrolytic stability and shear stress stability. It would also be desirable to improve soot dispersancy, especially where the lubricating oil is intended for use in diesel engine crankcases.

Polyalkylene succinimides are generally prepared by the reaction of the corresponding polyalkylene succinic anhydride with a polyalkyl polyamine. Polyalkylene succinic anhydrides are generally prepared by a number of well-known processes. For example, there is a well-known thermal process (see, e.g., U.S. Pat. No. 3,361,673), an equally well-known chlorination process (see, e.g., U.S. Pat. No. 3,172,892), a combination of the thermal and chlorination processes (see, e.g., U.S. Pat. No. 3,912,764), and free radical processes (see, e.g., U.S. Pat. Nos. 5,286,799 and 5,319,030). Such compositions include one-to-one monomeric adducts (see, e.g., U.S. Pat. Nos. 3,219,666 and 3,381,022), as well as "multiply adducted" products, adducts having alkenyl-derived substituents adducted with at least 1.3 succinic groups per alkenyl-derived substituent (see, e.g., U.S. Pat. No. 4,234,435).

U.S. Pat. Nos. 3,361,673 and 3,018,250 describe the reaction of an alkenyl- or alkyl-substituted succinic anhydride with a polyamine to form alkenyl or alkyl succinimide lubricating oil dispersants and/or detergent additives.

U.S. Pat. No. 4,612,132 teaches that alkenyl or alkyl succinimides may be modified by reaction with a cyclic or linear carbonate or chloroformate such that one or more of the nitrogens of the polyamine moiety is substituted with a hydrocarbyl oxycarbonyl, a hydroxyhydrocarbyl oxycarbonyl, or a hydroxy poly(oxyalkylene)oxycarbonyl. These modified succinimides are described as exhibiting improved dispersancy and/or detergency in lubricating oils.

U.S. Pat. No. 4,747,965 discloses modified succinimides similar to those disclosed in U.S. Pat. No. 4,612,132, except that the modified succinimides are described as being derived from succinimides having an average of greater than 1.0 succinic groups per long chain alkenyl substituent.

U.S. Pat. No. 4,234,435 teaches a preferred polyalkene-derived substituent group with a Mn in the range of 1500–3200. For polybutenes, an especially preferred Mn range is 1700–2400. This patent also teaches that the succinimides must have a succinic ratio of at least 1.3. That is, there should be at least 1.3 succinic groups per equivalent weight of polyalkene-derived substituent group. Most preferably, the succinic ratio should be from 1.5 to 2.5. This patent further teaches that its dispersants also provide an improvement in viscosity index. That is, these additives impart fluidity modifying properties to lubricant compositions containing them. This is considered desirable for use in multigrade lubricating oils but undesirable for single-grade lubricating oils.

Polyamino alkenyl or alkyl succinimides and other additives useful as dispersants and/or detergents, such as Mannich bases, contain basic nitrogen. While basicity is an important property to have in the dispersant/detergent additive, it is believed that the initial attack on fluorocarbon elastomer seals used in some engines involves attack by the basic nitrogen. This attack leads to the loss of fluoride ions, and eventually results in cracks in the seals and loss of other desirable physical properties in the elastomer.

A variety of post-treatments for improving various properties of alkenyl succinimides are known in the art, a number of which are described in U.S. Pat. No. 5,241,003.

U.S. Pat. No. 5,112,507 discloses a polymeric ladder type polymeric succinimide dispersant in which each side of the ladder is a long chain alkyl or alkenyl, generally having at least about 30 carbon atoms, preferably at least about 50 carbon atoms. The dispersant is described as having improved hydrolytic stability and shear stress stability, produced by the reaction of certain maleic anhydride-olefin copolymers with certain polyamines. In one embodiment, a mixture of maleic anhydride-olefin copolymers and thermal PIBSA is reacted with certain polyamines. The patent further teaches that the polymer may be post-treated with a variety of post-treatments, and describes procedures for post-treating the polymer with cyclic carbonates, linear mono- or polycarbonates; boron compounds (e.g., boric acid), and fluorophosphoric acid and ammonium salts thereof.

U.S. Pat. Nos. 5,334,321 and 5,356,552 disclose certain cyclic carbonate post-treated alkenyl or alkylsuccinimides having improved fluorocarbon elastomer compatibility, which are preferably prepared by the reaction of the corresponding substituted succinic anhydride with a polyamine having at least four nitrogen atoms per mole.

U.S. Pat. No. 5,175,225 discloses a process for preparing an oligomeric copolymer of an unsaturated acid reactant and a high molecular weight olefin in the presence of a solvent. In one embodiment, the solvent can be a thermal PIBSA.

U.S. Pat. No. 5,670,462 discloses a process which comprises reacting a copolymer of an olefin and maleic anhydride, an acyclic hydrocarbyl-substituted succinic acylating agent, and an alkylene polyamine. These products are useful in lubricating oil compositions as additives for use as dispersants having viscosity index improver properties.

U.S. Pat. No. 5,716,912 discloses a polysuccinimide composition prepared by reacting a mixture of an alkenyl or alkylsuccinic acid derivative, unsaturated acidic reagent copolymer, and a polyamine. The alkenyl or alkyl substituent of the alkenyl or alkylsuccinic acid derivative has a Mn of from 1800 to 3000. The unsaturated acidic reagent copolymer is a copolymer of an unsaturated acidic reagent and an olefin having an average of from 14 to 30 carbon atoms, wherein the copolymer has a Mn of from 2,000 to 4,800. The polyamine has at least three nitrogen atoms and 4 to 20 carbon atoms.

SUMMARY OF THE INVENTION

The present invention provides novel polymers comprising polyalkylene polysuccinimides and post-treated derivatives thereof. These polymers, and in particular the post-treated derivatives, have excellent dispersant properties, improved hydrolytic and shear stress stability, and improved fluorocarbon elastomer compatibility. In a preferred embodiment the polymers are essentially chlorine-free.

The polyalkylene polysuccinimides of the present invention can be prepared by the reaction of alkyl or alkenyl succinic acid derivatives with certain copolymers of an unsaturated acidic reagent (copolymers of unsaturated acidic reagents and olefins) and a polyamine having at least three nitrogens per molecule. The olefin moiety of the copolymer may also be substituted with various substituents, so long as the substituent does not interfere with the reaction or adversely affect performance of the product. Because of competing and sequential reactions, the reaction product will be a mixture of compounds, which function as dispersants. Thus, by varying the mole ratio of reactants, variations in the products, and correspondingly variations in the properties of product, can be obtained. The reaction product will be a mixture because all of the reactants are generally furnished commercially as mixtures.

It is believed that the improvement in properties is primarily due to the production of a new polyalkylene polysuccinimide that can be represented by the following formula:

(I)

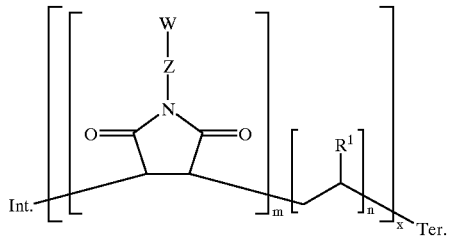

wherein:

W is a nitrogen-containing group which is a mixture of

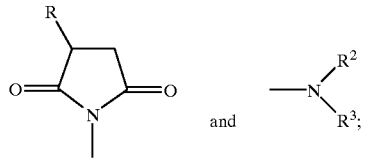

R is a polyalkyl or polyalkylene having a number average molecular weight of about 140 to 3000;

$R^1$ is an alkyl having a number average molecular weight of about 1800 to 3000;

Z is a polyalkylene polyamine linking radical;

m is a whole integer of from 1 to 3;

n is a whole integer of from 1 to 3;

x is a whole integer of from 2 to 20;

Int. is an initiating radical;

Ter. is a terminating group; and wherein $R^2$ and $R^3$ are independently hydrogen, alkyl, phenyl, or taken together are alkylene to give a ring group.

The (Int.) and (Ter.) substituent are carried over into the present composition from the maleic anhydride reactant and are present in the copolymer reactants as a result of the free radical initiator used to prepare the copolymer. Typical (Int.) and (Ter.) groups include

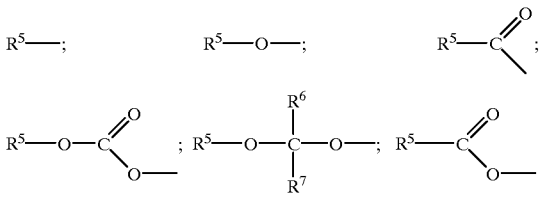

wherein $R^5$ is hydrogen, alkyl, aryl, alkaryl, cycloalkyl, alkoxy, cycloalkoxy, acyl, alkenyl, cycloalkenyl, alkynyl; or alkyl, aryl or alkaryl optionally substituted with 1 to 4 substituents independently selected from nitrile, keto, halogen, nitro, alkyl, aryl, and the like; and $R^6$ and $R^7$ are independently hydrogen, alkyl, aryl, alkaryl, and the like.

Typically the (Int.) group and (Ter.) group will be the same but may also be different because of secondary or competing reactions in the initial copolymerization or the subsequent reaction used to prepare the composition of the present invention; including, in some reaction with organic solvents such as toluene, resulting in a benzyl radical initiator or terminating group.

A major difference between the above structure and structures of the prior art is that $R^1$, the alkyl group attached to the copolymer backbone, has a number average molecular weight of at least 1000, preferably about 1800 to 3000. This is much higher than the typical size of 12 to 28 carbon atoms (Mn of 168 to 252) found in prior art structures.

The corresponding post-treated derivative can be obtained by treating the reaction product with the desired post-treatment. For example, the reaction product is preferably treated with a cyclic carbonate, preferably ethylene carbonate, preferably by the procedure described in U.S. Pat. Nos. 4,612,132 and 5,334,321 hereby incorporated by reference. Alternatively, the reaction product can be treated under reactive conditions with a boron compound selected from the group consisting of boron oxide, boron halide, boric acid, and esters of boric acid.

The present invention further provides lubricating oil compositions comprising a major amount of a base oil of lubricating viscosity and a minor amount of the compounds of the invention ("active ingredients"). The active ingredients can be applied at effective amounts, which are highly effective to control engine sludge and varnish and yet be compatible with fluorocarbon elastomer engine seals. The invention also provides a concentrate comprising about 20% to 60% of the compounds or compound mixtures and about 40% to 80% of a compatible liquid diluent designed to be added directly to a base oil. Both the lubricating oil composition and concentrate may also contain other additives designed to improve the properties of the base oil, including other detergent-dispersants.

The present invention further provides a fuel composition comprising a major amount of hydrocarbons boiling in the gasoline or diesel range and from 10 to 10,000 parts per million of the hydrocarbon of a compound or mixture of compounds of the present invention.

The composition of the present invention can be prepared reacting a mixture under reactive conditions, wherein the mixture comprises:

(a) an alkenyl or alkylsuccinic acid derivative, wherein the alkenyl or alkyl substituent has a Mn of from 140 to 3000;

(b) an unsaturated acidic reagent copolymer of
  (1) an unsaturated acidic reagent and
  (2) an olefin having a Mn of at least 1000 (preferable from 1800 to 3000), wherein the copolymer has an average degree of polymerization of from 2 to 20; and (c) a polyamine having at least three nitrogen atoms and 4 to 20 carbon atoms.

Preferably, the mixture contains about from 0.1 to 1.0 equivalents of the alkenyl or alkylsuccinic acid derivative per equivalent of the unsaturated acidic reagent copolymer and about from 0.4 to 1.0 moles of the polyamine per equivalent of the sum of alkenyl or alkylsuccinic acid derivative and unsaturated acidic reagent copolymer. Preferably, the acid derivative is an anhydride wherein the alkenyl or alkyl substituent of the alkenyl or alkylsuccinic acid derivative has a Mn of from 140 to 420, and the unsaturated acidic reagent copolymer is a copolymer of maleic anhydride and an olefin, and the polyamine has from six to ten nitrogen atoms per molecule.

Additional aspects of the invention will be apparent from the following detailed description.

DETAILED DESCRIPTION OF THE INVENTION

In one aspect, the present invention involves a polysuccinimide having the general formula:

(I)

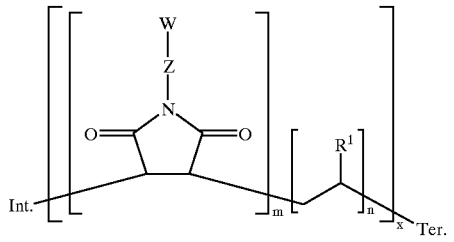

wherein:

W is a nitrogen-containing group which is a mixture of

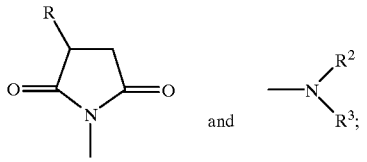

R is a polyalkyl or polyalkylene having a number average molecular weight of about 140 to 3000 (preferably 140 to 420);

$R^1$ is an alkyl having a number average molecular weight of at least 1000, (preferably about 1800 to 3000);

Z is a polyalkylene polyamine linking radical;

m is a whole integer of from 1 to 3;

n is a whole integer of from 1 to 3;

x (the average degree of polymerization) is a whole integer of from 2 to 20;

Int. is an initiating radical;

Ter. is a terminating group; and wherein $R^2$ and $R^3$ are independently hydrogen, alkyl, phenyl, or taken together are alkylene to give a ring group.

In simplified terms, the compound of formula (I), shown above, can be considered a polyalkylene polysuccinimide produced by the reaction of a copolymer (the unsaturated acidic reagent copolymer) with a monomer (the alkene or alkyl succinic acid derivative) in which the monomer is linked to the polymer units by a polyamine linking group. Because the polyalkylene polysuccinimide mixture contains about from 0.1 to 1.0 equivalents of alkenyl or alkylsuccinic acid derivative per equivalent of unsaturated acidic reagent copolymer, and about from 0.4 to 1.0 equivalents of polyamine per equivalent of the sum of alkenyl or alkyl succinic acid derivative and unsaturated acidic reagent copolymer, other structures, such as (II) and (III), shown below, can also be present, depending on the ratios of alkenyl or alkylsuccinic acid derivative, unsaturated acidic reagent copolymer, and polyamine.

(II)

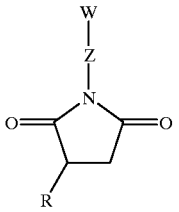

-continued (III)

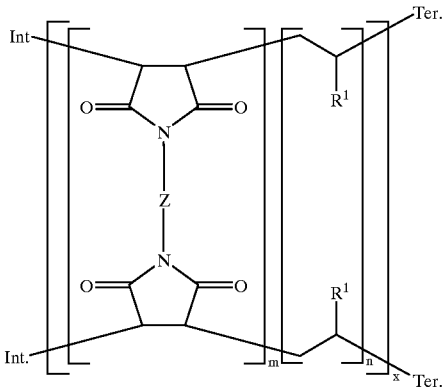

wherein W, R, $R^1$, $R^2$, $R^3$, Z, m, n, x, Int., and Ter. are the same as described above.

In addition to the predominant polymer of formula (I), (II), or (III), the reaction will typically contain more complex reaction products and polymers because of competing and sequential reactions, and because the alkenyl or alkylsuccinic acid derivative might contain more than one succinic anhydride moiety per long chain alkyl or alkenyl group or contain unsaturated acidic reagent oligomers.

Referring to formulas (I), (II), and (III), the preferred compounds or compound mixtures are those wherein Z is a polyamino radical having about from 3 to 7, more preferably, about 4 to 5 nitrogen atoms and 8 to 20 carbon atoms.

The initiating group and terminating group will be a function of the initiator used to initiate the free radical reaction used to prepare the copolymer and may vary with the particular copolymer and secondary reactions. Discounting secondary reactions, the preferred Int. and Ter. groups are where $R^1$ is

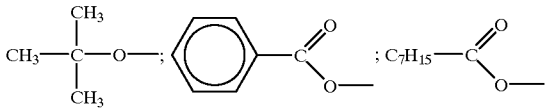

DEFINITIONS

As used herein the following terms have the following meanings, unless expressly stated to the contrary.

The term "succinimide" is understood in the art to include many of the amide, imide, etc. species which are also formed by the reaction of a succinic anhydride with an amine. The predominant product, however, is succinimide and this term has been generally accepted as meaning the product of a reaction of an alkenyl- or alkyl-substituted succinic acid or anhydride with a polyamine. Alkenyl or alkyl succinimides are disclosed in numerous references and are well known in the art. Certain fundamental types of succinimides and related materials encompassed by the term of art "succinimide" are taught in U.S. Pat. Nos. 2,992,708; 3,018,291; 3,024,237; 3,100,673; 3,219,666; 3,172,892; and 3,272,746, the disclosures of which are hereby incorporated by reference.

The term "polysuccinimide" refers to a compound that is formed by the reaction of an unsaturated acidic reagent copolymer and an alkene or alkyl succinic acid derivative with an amine.

The term "Total Base Number" or "TBN" refers to the amount of base equivalent to milligrams of KOH in 1 gram of sample. Thus, higher TBN numbers reflect more alkaline products and therefore a greater alkalinity reserve. The TBN of a sample can be determined by ASTM D 2896 or any other equivalent procedure.

The term "SAP" refers to Saponification Number and can be determined by the procedure described in ASTM D 94 or any other equivalent procedure.

The term "TAN" refers to Total Acid Number and can be determined by the procedure described in ASTM D 664 or any other equivalent procedure.

The "succinic ratio" or "succination ratio" refers to the ratio calculated in accordance with the procedure and mathematical equation set forth in columns 5 and 6 of U.S. Pat. No. 5,334,321, hereby incorporated by reference. The calculation is asserted to represent the average number of succinic groups in an alkenyl or alkylsuccinic anhydride per alkenyl or alkyl chain.

The term "PIBSA" means polyisobutenyl succinic anhydride.

The term "polyPIBSA" means a copolymer of polyisobutene and an unsaturated acidic reactant. Such copolymers are described in detail in U.S. Pat. No. 5,112,507.

The term "hydrocarbon soluble compatible salt" refers to a salt which is soluble in an oil of lubricating viscosity or a hydrocarbon fuel suitable for use in spark-ignition or diesel engines and which is compatible with such composition.

The term "alkenyl or alkylsuccinic acid derivative" refers to a structure having the formula:

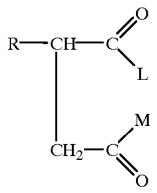

wherein L and M are independently selected from the group consisting of —OH, —Cl, —O—, lower alkyl or taken together are —O— to form an alkenyl or alkylsuccinic anhydride group.

The term "unsaturated acidic reagent" refers to maleic or fumaric reactants of the general formula:

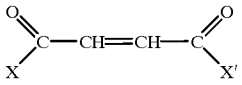

wherein X and X' are the same or different, provided that at least one of X and X' is a group that is capable of reacting to esterify alcohols, form amides, or amine salts with ammonia or amines, form metal salts with reactive metals or basically reacting metal compounds and otherwise function as acylating agents. Typically, X and/or X' is —OH, —O-hydrocarbyl, —$OM^+$ where $M^+$ represents one equivalent of a metal, ammonium or amine cation, —$NH_2$, —Cl, —Br, and taken together X and X' can be —O— so as to form an anhydride. Preferably, X and X' are such that both carboxylic functions can enter into acylation reactions. Maleic anhydride is a preferred unsaturated acidic reactant. Other suitable unsaturated acidic reactants include electron-deficient olefins such as monophenyl maleic anhydride;

monomethyl, dimethyl, monochloro, monobromo, monofluoro, dichloro and difluoro maleic anhydride, N-phenyl maleimide and other substituted maleimides; isomaleimides; fumaric acid, maleic acid, alkyl hydrogen maleates and fumarates, dialkyl fumarates and maleates, fumaronilic acids and maleanic acids; and maleonitrile, and fumaronitrile.

Unless otherwise specified, all molecular weights are number average molecular weights (Mn).

Unless otherwise specified, all percentages are in weight percent and are based on the amount of active and inactive components, including any process oil or diluent oil used to form that component.

Synthesis

The compounds of the present invention can be prepared by contacting the desired alkyl or alkenyl succinic acid derivative with an unsaturated acidic reagent copolymer and polyamine under reactive conditions:

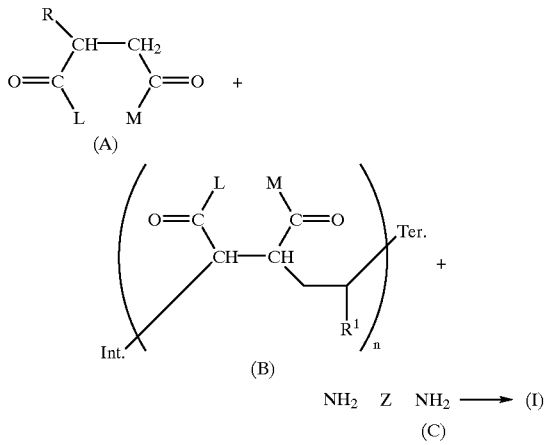

wherein R, $R^1$, Z, L, M, n, Int., and Ter. are as defined above.

Typically the above process is conducted by contacting from 0.1 to 1.0 equivalents of alkenyl or alkylsuccinic acid derivative (A) per mole of unsaturated acidic reagent copolymer (B) and from 0.4 to 1.0 equivalents of amine (C) per equivalent of the sum of alkenyl or alkylsuccinic acid derivative (A) and unsaturated acidic reagent copolymer (B). In conducting this reaction we have generally found it convenient to first add the alkenyl or alkylsuccinic acid derivative and the unsaturated acidic reagent copolymer together and then add the polyamine. It may be desirable to conduct the reaction in an inert organic solvent. Optimum solvents will vary with the particular copolymer and can be determined from literature sources or routine experimentation.

Typically, the reaction is conducted at temperatures in the range of about from 140° to 180° C., preferably 150° to 170° C. for about from 1 to 10 hours, preferably 4 to 6 hours. Typically, the reaction is conducted at about atmospheric pressure; however, higher or lower pressures can also be used depending on the reaction temperature desired and the boiling point of the reactants or solvent.

As above noted, the reaction product will typically be a mixture, both because of the secondary products or byproducts and also because the reactants will typically be mixtures. In theory, pure compounds could be obtained, for example by using pure compounds as reactants and then separating out the desired pure compounds from the reaction product. However, commercially, the expense of this would rarely be justified and accordingly the commercial product will generally be a mixture in which formulas (I), (II), and (III) will be the predominant compounds.

Water, present in the system or generated by the reaction of the amine with the succinic or maleic anhydride moieties of (A) and (B) alkyl polysuccinimide, is preferably removed from the reaction system during the course of the reaction via azeotroping or distillation. After reaction completion, the system can be stripped at elevated temperatures (typically 100° C. to 250° C.) and reduced pressures to remove any volatile components which may be present in the product.

The Alkenyl or Alkylsuccinic Acid Derivatives—Reactant (A)

Alkyl and alkenylsuccinic acid derivatives used in the present process preferably have a calculated succinic ratio of about from 1.0:1 to 2.5:1, and more preferably about from 1.0:1 to 1.5:1. Most preferably, the alkyl or alkenyl succinic acid derivatives have a succination ratio of about from 1.0:1 to 1.2:1. Preferably, alkyl or alkenylsuccinic anhydrides are used. Accordingly, we prefer to use alkenyl succinic anhydride prepared by the thermal process, both because the calculated succination ratio of material prepared by this process is typically 1.0:1 to 1.2:1, and because the product is essentially chlorine-free because chlorine is not used in the synthesis. In one embodiment, the alkenyl succinic anhydrides are prepared using strong acid catalysts.

The thermal reaction of a polyolefin with maleic anhydride is well known and is described, for example, in U.S. Pat. No. 3,361,673. The less desirable is the chlorination process characterized by the reaction of a chlorinated polyolefin with maleic anhydride, which is also well known and is described, for example, in U.S. Pat. No. 3,172,189. Various modifications of the thermal process and chlorination process are also well known, some of which are described in U.S. Pat. Nos. 4,388,471; 4,450,281; 3,018,250 and 3,024,195. Free radical procedures for preparing alkenyl succinic anhydrides are, for example, described in U.S. Pat. Nos. 5,286,799 and 5,319,030. The strong acid catalyzed preparation of alkyl or alkenyl succinic anhydrides is described in U.S. Pat. Nos. 3,819,660 and 3,855,251. All of the above referenced patents are hereby incorporated herein by reference in their entirety.

In accordance with the invention, the alkenyl or alkyl succinic anhydride reactant is derived from a polyolefin having a Mn from 140 to 3000 (preferably from 140 to 420).

Suitable polyolefin polymers for reaction with maleic anhydride include polymers comprising a major amount of $C_2$ to $C_5$ monoolefin, e.g., ethylene, propylene, butylene, iso-butylene, and pentene. The polymers can be homopolymers, such as polyethylene, polypropylene, and polyisobutylene, as well as copolymers of two or more such olefins, such as copolymers of: ethylene and propylene, butylene, and isobutylene, etc.

One preferred class of olefin polymers for reaction with maleic anhydride comprises the polybutenes, which are prepared by polymerization of one or more of 1-butene, 2-butene, and isobutene. Especially desirable are polybutenes containing a substantial proportion of units derived from isobutene. The polybutene may contain minor amounts of butadiene, which may or may not be incorporated in the polymer. These polybutenes are readily available commercial materials well known to those skilled in the art. Examples of procedures illustrating the preparation of such materials can be found, for example, in U.S. Pat. Nos. 3,215,707; 3,231,587; 3,515,669; 3,579,450; 3,912,764 and 4,605,808, hereby incorporated by reference for their disclosures of suitable polybutenes.

A second class of olefin polymers for reaction with maleic anhydride comprises the polypropylenes, which are prepared by polymerization of one or more of 1-propene. Especially preferred polypropylene compounds are the low molecular weight polypropylene compounds, propylene trimer, tetramer, and pentamer.

A third class of olefin polymers for reaction with maleic anhydride comprises the polyethylenes, which are prepared by polymerization of ethylene. Especially preferred polyethylene compounds are the low molecular weight ethylene oligomers known as alpha olefins. The most preferred polyethylene compounds are the $C_4$ to $C_{30}$ alpha olefins.

The alkenyl or alkylsuccinic anhydride may also be prepared using the so-called highly reactive or high methylvinylidene polyalkylene, most commonly polyisobutene, such as described in U.S. Pat. Nos. 4,152,499; 5,071,919; 5,137,980; 5,286,823; 5,254,649; published International Applications Numbers WO 93 24539-A1; WO 9310063-A1; and published European Patent Applications Numbers 0355895-A; 0565285A; and 0587381A, all of which are hereby incorporated by reference in their entirety. Other polyalkenes can also be used including, for example, polyalkenes prepared using metallocene catalysts such as for example described in published German patent application DE 4313088A1.

The Unsaturated Acidic Reagent Copolymer—Reactant (B)

The unsaturated acidic reagent copolymers used in the present invention can be random copolymers or alternating copolymers, and can be prepared by known procedures for example as disclosed in U.S. Pat. No. 5,112,507. Such copolymers may be prepared by the free radical reaction of an unsaturated acidic reagent with the corresponding monomer of the other unit of the copolymer. Accordingly, the unsaturated acidic reagent copolymer can be prepared by the free radical reaction of an unsaturated acidic reagent, preferably maleic anhydride, with the corresponding olefin having a Mn of at least 1000, preferably from 1800 to 3000.

The average degree of polymerization of the copolymers can vary over a wide range. In general, copolymers of high molecular weight can be produced at low temperatures and copolymers of low molecular weight can be produced at high temperatures. It has been generally shown that for the polymers of this invention, we prefer low molecular weight copolymers, i.e., copolymers with a low average degree of polymerization.

In one embodiment, the copolymer is first prepared by a free radical reaction of the unsaturated acidic reagent with the olefin. Then, in the same reactor, any unreacted olefin is reacted further in a strong acid catalyzed ene reaction to produce the alkenyl or alkyl succinic acid derivative. This effectively produces a mixture of the copolymer and the alkenyl or alkyl succinic acid derivative in the same reaction mixture. The advantage of the strong acid catalyst is that higher total conversions of the olefin are observed.

The Polyamine Reactant (C)

The polyamine reactant should have at least three amine nitrogen atoms per molecule, and preferably 4 to 12 amine nitrogens per molecule. Most preferred are polyamines having from about 6 to about 10 nitrogen atoms per molecule. The number of amine nitrogen atoms per molecule of polyamine is calculated as follows:

$$\begin{array}{c}\text{Average number of nitrogen}\\ \text{atoms in molecule of polyamine}\end{array} = \frac{\% N \times M_{pa}}{14 \times 100}$$

wherein

% N=percent nitrogen in polyamine or polyamine mixture, $M_{pa}$=number average molecular weight of the polyamine or polyamine mixture.

Preferred polyalkylene polyamines also contain from about 4 to about 20 carbon atoms, there being preferably from 2 to 3 carbon atoms per alkylene unit. The polyamine preferably has a carbon-to-nitrogen ratio of from 1:1 to 10:1.

Examples of suitable polyamines that can be used to form the compounds of this invention include the following: tetraethylene pentamine, pentaethylene hexamine, Dow E-100® heavy polyamine (Mn=303, available from Dow Chemical Company, Midland, Mich.), and Union Carbide HPA-X heavy polyamine (Mn=275, available from Union Carbide Corporation, Danbury, Conn.). Such amines encompass isomers, such as branched-chain polyamines, and the previously mentioned substituted polyamines, including hydrocarbyl-substituted polyamines. HPA-X heavy polyamine ("HPA-X") contains an average of approximately 6.5 amine nitrogen atoms per molecule. Such heavy polyamines generally afford excellent results.

The polyamine reactant may be a single compound but typically will be a mixture of compounds reflecting commercial polyamines. Typically, the commercial polyamine will be a mixture in which one or several compounds predominate with the average composition indicated. For example, tetraethylene pentamine prepared by the polymerization of aziridine or the reaction of dichloroethylene and ammonia will have both lower and higher amine members, e.g., triethylene tetramine ("TETA"), substituted piperazines and pentaethylene hexamine, but the composition will be largely tetraethylene pentamine and the empirical formula of the total amine composition will closely approximate that of tetraethylene pentamine.

Other examples of suitable polyamines include admixtures of amines of various sizes, provided that the overall mixture contains on average at least four nitrogen atoms per molecule. Included within these suitable polyamines are mixtures of diethylene triamine ("DETA") and heavy polyamine. A preferred polyamine admixture reactant is a mixture containing 20% DETA and 80% HPA-X; as determined by the method described above, this preferred polyamine reactant contains an average of about 5.2 nitrogen atoms per molecule.

Methods of preparation of polyamines and their reactions are detailed in Sidgewick's THE ORGANIC CHEMISTRY OF NITROGEN, Clarendon Press, Oxford, 1966; Noller's CHEMISTRY OF ORGANIC COMPOUNDS, Saunders, Philadelphia, 2nd Ed., 1957; and Kirk-Othmer's ENCYCLOPEDIA OF CHEMICAL TECHNOLOGY, 2nd Ed., especially Volumes 2, pp. 99–116.

Post-Treatments

We have found that the dispersancy of the present polymers is generally further improved by reaction with a cyclic carbonate. This may result in some reduction in fluorocarbon elastomer compatibility. However, this generally can be more than offset by reducing the concentration of the carbonated post-treated polymer in light of the increased dispersancy. The cyclic carbonate post-treatment is especially advantageous where the dispersant will be used in engines which do not have fluorocarbon elastomer seals. The resulting modified polymer has one or more nitrogens of the polyamino moiety substituted with a hydroxy hydrocarbyl oxycarbonyl, a hydroxy poly(oxyalkylene)oxycarbonyl, a hydroxyalkylene, hydroxyalkylenepoly-(oxyalkylene), or mixture thereof.

The cyclic carbonate post-treatment is conducted under conditions sufficient to cause reaction of the cyclic carbonate with secondary amino group of the polyamino substituents. Typically, the reaction is conducted at temperatures of about from 0° to 250° C. preferably about from 100° to 200° C. Generally, best results are obtained at temperatures of about from 150° to 180° C.

The reaction may be conducted neat, wherein both the polymer and the cyclic carbonate are combined in the proper ratio, either alone or in the presence of a catalyst (such as an acidic, basic or Lewis acid catalyst). Depending on the viscosity of the polymer reactant, it may be desirable to conduct the reaction using an inert organic solvent or diluent, for example, toluene or xylene. Examples of suitable catalysts include phosphoric acid, boron trifluoride, alkyl or aryl sulfonic acid, alkali or alkaline carbonate. Generally, the same solvents or diluents as described above with respect to the preparation for the co-polymer (A) or polymer (I) can also be used in the cyclic carbonate post-treatment.

The reaction of polyamino alkenyl or alkyl succinimides with cyclic carbonates is known in the art and is described in U.S. Pat. No. 4,612,132, hereby incorporated by reference, in its entirety. Generally, the procedures described to post-treat polyamino alkenyl or alkyl succinimides with cyclic carbonates can also be applied to post-treat the present polymers.

A particularly preferred cyclic carbonate is 1,3-dioxolan-2-one (ethylene carbonate) because it affords excellent results and also because it is readily commercially available.

The molar charge of cyclic carbonate employed in the post-treatment reaction is preferably based upon the theoretical number of basic nitrogens contained in the polyamino substituent of the succinimide. Thus, when one equivalent of tetraethylene pentamine ("TEPA") is reacted with one equivalent of succinic anhydride and one equivalent of copolymer, the resulting bis succinimide will theoretically contain three basic nitrogens. Accordingly, a molar charge of two would require that two moles of cyclic carbonate be added for each basic nitrogen or, in this case, six moles of cyclic carbonate for each mole equivalent of polyalkylene succinimide or succinimide prepared from TEPA. Mole ratios of the cyclic carbonate to the basic amine nitrogen of the polyamino alkenyl succinimide employed in the process of this invention are typically in the range of from about 1:1 to about 4:1; although preferably from about 2:1 to about 3:1.

As described in U.S. Pat. No. 4,612,132, cyclic carbonates may react with the primary and secondary amines of a polyamino alkenyl or alkyl succinimide to form two types of compounds. In the first instance, strong bases, including unhindered amines such as primary amines and some secondary amines, react with an equivalent of cyclic carbonate to produce a carbamic ester. In the second instance, hindered bases, such as hindered secondary amines, may react with an equivalent of the same cyclic carbonate to form a hydroxyalkyleneamine linkage. (Unlike the carbamate products, the hydroxyalkyleneamine products retain their basicity.) Accordingly, the reaction of a cyclic carbonate may yield a mixture of products. When the molar charge of the cyclic carbonate to the basic nitrogen of the succinimide is about 1 or less, a large portion of the primary and secondary amines of the succinimide will be converted to hydroxy hydrocarbyl carbamic esters with some hydroxyhydrocarbylamine derivatives also being formed. As the mole ratio is raised above 1 increased amounts of poly(oxyalkylene) polymers of the carbamic esters and the hydroxyhydrocarbylamine derivatives are produced.

Both the polymers and post-treated polymers of this invention can also be reacted with boric acid or a similar boron compound to form borated dispersants having utility within the scope of this invention. In addition to boric acid (boron acid), examples of suitable boron compounds include boron oxides, boron halides and esters of boric acid. Generally from about 0.1 equivalents to 10 equivalents of boron compound to the modified succinimide may be employed.

In addition to the carbonate and boric acid post-treatments, both of the compounds may be post-treated, or further post-treated, with a variety of post-treatments designed to improve or impart different properties. Such post-treatments include those summarized in columns 27–29 of U.S. Pat. No. 5,241,003, hereby incorporated by reference. Such treatments include, treatment with:

Inorganic phosphorous acids or anhydrates (e.g., U.S. Pat. Nos. 3,403,102 and 4,648,980);

Organic phosphorous compounds (e.g., U.S. Pat. No. 3,502,677);

Phosphorous pentasulfides;

Boron compounds as already noted above (e.g., U.S. Pat. Nos. 3,178,663 and 4,652,387);

Carboxylic acid, polycarboxylic acids, anhydrides and/or acid halides (e.g., U.S. Pat. Nos. 3,708,522 and 4,948,386);

Epoxides, polyepoxides, or thioepoxides (e.g., U.S. Pat. Nos. 3,859,318 and 5,026,495);

Aldehyde or ketone (e.g., U.S. Pat. No. 3,458,530);

Carbon disulfide (e.g., U.S. Pat. No. 3,256,185);

Glycidol (e.g., U.S. Pat. No. 4,617,137);

Urea, thiourea, or guanidine (e.g., U.S. Pat. Nos. 3,312,619; 3,865,813; and British Patent GB 1,065,595);

Organic sulfonic acid (e.g., U.S. Pat. No. 3,189,544 and British Patent GB 2,140,811);

Alkenyl cyanide (e.g., U.S. Pat. Nos. 3,278,550 and 3,366,569);

Diketene (e.g., U.S. Pat. No. 3,546,243);

A diisocyanate (e.g., U.S. Pat. No. 3,573,205);

Alkane sultone (e.g., U.S. Pat. No. 3,749,695);

1,3-Dicarbonyl Compound (e.g., U.S. Pat. No. 4,579,675);

Sulfate of alkoxylated alcohol or phenol (e.g., U.S. Pat. No. 3,954,639);

Cyclic lactone (e.g., U.S. Pat. Nos. 4,617,138; 4,645,515; 4,668,246; 4,963,275; and 4,971,711);

Cyclic carbonate or thiocarbonate linear monocarbonate or polycarbonate, or chloroformate (e.g., U.S. Pat. Nos. 4,612,132; 4,647,390; 4,648,886; 4,670,170);

Nitrogen-containing carboxylic acid (e.g., U.S. Pat. No. 4,971,598 and British Patent GB 2,140,811);

Hydroxy-protected chlorodicarbonyloxy compound (e.g., U.S. Pat. No. 4,614,522);

Lactam, thiolactam, thiolactone, or dithiolactone (e.g., U.S. Pat. Nos. 4,614,603 and 4,666,460);

Cyclic carbonate or thiocarbonate, linear monocarbonate or polycarbonate, or chloroformate (e.g., U.S. Pat. Nos. 4,612,132; 4,647,390; 4,646,860; and 4,670,170);

Nitrogen-containing carboxylic acid (e.g., U.S. Pat. No. 4,971,598 and British Patent GB 2,440,811);

Hydroxy-protected chlorodicarbonyloxy compound (e.g., U.S. Pat. No. 4,614,522);

Lactam, thiolactam, thiolactone or dithiolactone (e.g., U.S. Pat. Nos. 4,614,603, and 4,666,460);

Cyclic carbamate, cyclic thiocarbamate or cyclic dithiocarbamate (e.g., U.S. Pat. Nos. 4,663,062 and 4,666,459);

Hydroxyaliphatic carboxylic acid (e.g., U.S. Pat. Nos. 4,482,464; 4,521,318; 4,713,189);

Oxidizing agent (e.g., U.S. Pat. No. 4,379,064);

Combination of phosphorus pentasulfide and a polyalkylene polyamine (e.g., U.S. Pat. No. 3,185,647);

Combination of carboxylic acid or an aldehyde or ketone and sulfur or sulfur chloride (e.g., U.S. Pat. Nos. 3,390,086; 3,470,098);

Combination of a hydrazine and carbon disulfide (e.g. U.S. Pat. No. 3,519,564);

Combination of an aldehyde and a phenol (e.g., U.S. Pat. Nos. 3,649,229; 5,030,249; 5,039,307);

Combination of an aldehyde and an O-diester of dithiophosphoric acid (e.g., U.S. Pat. No. 3,865,740);

Combination of a hydroxyaliphatic carboxylic acid and a boric acid (e.g., U.S. Pat. No. 4,554,086);

Combination of a hydroxyaliphatic carboxylic acid, then formaldehyde and a phenol (e.g., U.S. Pat. No. 4,636,322);

Combination of a hydroxyaliphatic carboxylic acid and then an aliphatic dicarboxylic acid (e.g., U.S. Pat. No. 4,663,064);

Combination of formaldehyde and a phenol and then glycolic acid (e.g., U.S. Pat. No. 4,699,724);

Combination of a hydroxyaliphatic carboxylic acid or oxalic acid and then a diisocyanate (e.g. U.S. Pat. No. 4,713,191);

Combination of inorganic acid or anhydride of phosphorus or a partial or total sulfur analog thereof and a boron compound (e.g., U.S. Pat. No. 4,857,214);

Combination of an organic diacid then an unsaturated fatty acid and then a nitrosoaromatic amine optionally followed by a boron compound and then a glycolating agent (e.g., U.S. Pat. No. 4,973,412);

Combination of an aldehyde and a triazole (e.g., U.S. Pat. No. 4,963,278);

Combination of an aldehyde and a triazole then a boron compound (e.g., U.S. Pat. No. 4,981,492);

Combination of cyclic lactone and a boron compound (e.g., U.S. Pat. No. 4,963,275 and 4,971,711).

Lubricating Oil Compositions and Concentrates

The compositions of this invention are compatible with fluorocarbon elastomer seals, at concentrations at which they are effective as detergent and dispersant additives in lubricating oils. When employed in this manner, the modified polyamino alkenyl or alkyl polysuccinimide additive is usually present in from one to five percent (on a dry polymer basis) to the total composition and preferably less than three percent (on a dry or actives polymer basis). Dry or actives basis indicates that only the active ingredient of this invention are considered when determining the amount of the additive relative to the remainder of a composition (e.g., lube oil composition, lube oil concentrate, fuel composition, or fuel concentrate). Diluents and any other inactives are excluded.

The lubricating oil used with the additive compositions of this invention may be mineral oil or synthetic oils of lubricating viscosity and preferably suitable for use in the crankcase of an internal combustion engine. Crankcase lubricating oils typically have a viscosity of about 1300 cSt at 0° F. (−17.8° C.) to 22.7 cSt at 210° F. (99° C.). The lubricating oils may be derived from synthetic or natural sources. Mineral oil for use as the base oil in this invention includes paraffinic, naphthenic and other oils that are ordinarily used in lubricating oil compositions. Synthetic oils include both hydrocarbon synthetic oils and synthetic esters. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity such as didodecyl benzene can be used. Useful synthetic esters include the esters of both monocarboxylic acid and polycarboxylic acids as well as monohydroxy alkanols and polyols. Typical examples are didodecyl adipate, pentaerythritol tetracaproate, di-2-ethylhexyl adipate, dilaurylsebacate and the like. Complex esters prepared from mixtures of mono and dicarboxylic acid and mono and dihydroxy alkanols can also be used.

Blends of hydrocarbon oils with synthetic oils are also useful. For example, blends of 10 to 25 weight percent hydrogenated 1-decene trimer with 75 to 90 weight percent 150 SUS (100° F.) mineral oil gives an excellent lubricating oil base.

Other additives which may be present in the formulation include detergents (overbased and non-overbased), rust inhibitors, foam inhibitors, corrosion inhibitors, metal deactivators, pour point depressants, antioxidants, wear inhibitors, zinc dithiophosphates, and a variety of other well-known additives.

It is also contemplated the modified polysuccinimides of this invention may be employed as dispersants and detergents in hydraulic fluids, marine crankcase lubricants, and the like. When so employed, the modified polysuccinimide is added at from 0.1% to 5% (on a dry polymer basis) to the oil, and preferably at from 0.5% to 5% (on a dry polymer basis).

Additive concentrates are also included within the scope of this invention. The concentrates of this invention usually include from 90% to 10% of an organic liquid diluent and from 10% to 90% (on a dry polymer basis) of the additive of this invention. Typically, the concentrates contain sufficient diluent to make them easy to handle during shipping and storage. Suitable diluents for the concentrates include any inert diluent, preferably an oil of lubricating viscosity, so that the concentrate may be readily mixed with lubricating oils to prepare lubricating oil compositions. Suitable lubricating oils which can be used as diluents typically have viscosities in the range from about 35 to about 500 Saybolt Universal Seconds (SUS) at 100° F. (38° C.), although other oils of lubricating viscosity may be used.

Fuel Compositions and Concentrates

Typically, the fuel composition will contain about from 10 to 10,000 ppm, preferably from 30 to 2,000 ppm, of the polymer of the present invention in a base fuel. This is based on active ingredient including the other dispersant reaction products as well as the compounds of formula (I) but excluding inactives, for example diluent oil and any unreacted alkene or poly 1-olefins etc. carried through from the preparation of succinic anhydride (A) or copolymer (B). If other detergents are present, a lesser amount of the modified polysuccinimide may be used. Optimum concentrations can vary with the particular base fuel and the presence of other additives but can be determined by routine procedures.

The compositions of this invention may also be formulated as a fuel concentrate, using an inert stable oleophilic organic solvent boiling in the range of about 150° F. to 400° F. Preferably, an aliphatic or an aromatic hydrocarbon solvent is used, such as benzene, toluene, xylene or higher-boiling aromatics or aromatic thinners. Aliphatic alcohols of about three to eight carbon atoms, such as isopropanol, isobutylcarbinol, n-butanol, and the like, in combination with hydrocarbon solvents are also suitable for use with the fuel additive. The present fuel concentrate will typically contain about from 20% to 60% of the present composition on an active ingredient basis.

EXAMPLES

A further understanding of the invention can be had in the following nonlimiting preparations and examples. Unless expressly stated to the contrary, all temperatures and temperature ranges refer to the Centigrade system and the term "ambient" or "room temperature" refers to about 20° C.–25° C. The term "percent" or "%" refers to weight percent and the term "mole" or "moles" refers to gram moles. The term "equivalent" refers to a quantity of reagent equal in moles to the moles of the preceding or succeeding reactant recited in that example in terms of finite moles or finite weight or volume.

These examples show the preparation of a mixture of a copolymer with a long alkyl tail and a PIBSA with a long alkyl tail.

Example 1

Preparation of a Mixture of PolyPIBSA and Thermal PIBSA From 1300 MW PIB

Into an autoclave at 100–110° C. was added 16.23 kilograms polyPIBSA, which was used as a solvent, and 49.0 kilograms Ultravis 30 polybutene (37.7 mole). The reactor was then purged with nitrogen and evacuated five times to remove oxygen. Then the reactor was pressurized to 20 psig with nitrogen. The temperature was increased to 136° C. and to this was added 4063.5 grams maleic anhydride (41.5 mole). The maleic anhydride/polybutene CMR was 1.1. To this was then added 114 grams di-t-butyl peroxide (0.78 mole) dissolved in hexane, over a 4.5 hour period. The peroxide/polybutene CMR was 0.02. The temperature was increased to 140° C.; during this time the pressure stayed constant at about 35 psia. After the peroxide addition was complete, the reaction was maintained at 140° C. for two hours. Then the reaction was heated to 190° C. for one hour to decompose any unreacted peroxide. Excess maleic anhydride was then remove by distillation in vacuo. This product was analyzed and found to contain polyPIBSA at 52% actives content. Then a total of 3034.65 grams maleic anhydride was added to 40.2 kilograms of the above, while the temperature was maintained at 232° C. The CMR of maleic anhydride/unreacted polybutene in the mixture was 2.1. The maleic anhydride was added in two portions. The first portion 760.8 grams was added over 30 minutes at 232° C. The second portion 2282.44 grams was added over four hours. Then excess maleic anhydride was removed by distillation in vacuo. This product, which was a mixture of polyPIBSA and thermal PIBSA, was found to contain 70% actives and had a SAP number of 62.8 mg KOH/gram. We estimate that this product contained 52% polyPIBSA and 18% thermal PIBSA. The PIBSA/copolymer anhydride ratio for this product was 18/52 or 0.35. To 39.5 kilograms of this product was then added about 13.2 kilograms of diluent oil. The percent actives for this material was 51% and the final SAP number for this material was 45.9 mg KOH/gram.

Example 2

Preparation of a Mixture of Polypisba and Thermal PIBSA From 2300 MW PIB

To a 22 liter flask equipped with a mechanical stirrer, thermometer, and a condenser was added 8251 grams (3.44 mole) of Glissopal 2300 polybutene. This was heated to 130° C. To this was added 370.72 grams (3.78 mole) maleic anhydride. The maleic anhydride/polybutene CMR was 1.1. Then to this was added 5.02 grams di-tert-butyl peroxide (0.034 mole) over one hour and the temperature was increased to 140° C. Then 5.02 grams di-tert-butyl peroxide (0.034 mole) was added over a four hour period. The reaction was then maintained at 140° C. for two hours. Then the temperature was increased to 190° C. for one hour to decompose the remaining peroxide. Then maleic anhydride 303.5 grams (3.096 mole) was added. The reaction was then heated at 230° C. and kept there for four hours. Then the maleic anhydride that was unreacted was removed in vacuo, and the product was cooled. The product was found to contain 66.1% actives and had a SAP number of 22.7 mg KOH/gram. We estimate that this product consisted of about 50% polyPIBSA and about 16% thermal PIBSA. To 8692 grams of this product was added 5669.4 grams diluent oil so that the percent actives equaled 40%.

These examples show the reaction product of a copolymer with a long alkyl tail, a PIBSA with a long alkyl tail and a polyamine, and examples of post treatment with ethylene carbonate.

Example 3

Preparation of 1300 MW Mono TETA Polysuccinimide

To a 500 ml, 3 neck flask equipped with a mechanical stirrer, thermometer, and a Dean Stark trap, was added 200 grams of the polyPIBSA/thermal PIBSA mixture (81.8 mmole) of Example 1. To this was added 69.94 grams diluent oil. This was heated with stirring to 115° C. and to this was added 10.4 g TETA (71.2 mmole) dropwise with stirring. The amine/anhydride CMR was 0.87. This was then heated at 170° C. for five hours and then cooled to room temperature. This product was analyzed and contained 1.38% N, a TBN of 27.1 mg KOH/gram, a TAN of 1.27 mg KOH/gram, and had a viscosity of 139 cSt at 100° C.

Examples 4–10

Preparation of Other 1300 MW Polysuccinimides

A number of other polysuccinimides were prepared according to the procedure of Example 3, using different charge mole ratios (CMR) and different amines. These products and their analyses are reported in Table 1.

Example 11

Post Treatment of 1300 MW Polysuccinimides

To a 1 liter three neck flask equipped with a thermometer, mechanical stirrer, and condenser, was added 250 grams of the bis TETA polysuccinimide prepared in Example 7. This was heated to 160° C. and to this was added 12.25 grams ethylene carbonate (139 mmole). The EC/basic nitrogen CMR was 2.0. This was heated at 165° C. for five hours then cooled. This product had 0.81% N, a TBN of 8.8 mg KOH/gram, a TAN of 0.07 mg KOH/gram, and a viscosity at 100° C. of 192 cSt.

Examples 12–14

Preparation of Other 1300 MW Post Treated Polysuccinimides

A number of other post treated polysuccinimides were synthesized according to the procedure of Example 11. These products were analyzed, and the data is reported in Table 1.

TABLE 1

ANALYSIS OF POLYSUCCINIMIDES PREPARED ACCORDING TO EXAMPLE 3

| Example | Post treat | Amine/PIBSA CMR | Amine | % N | Vis @ 100° C., cSt | TAN, mg KOH/g | TBN, mg KOH/g |
|---|---|---|---|---|---|---|---|
| 3 | | 0.87 | TETA | 1.38 | 139 | 1.27 | 27.1 |
| 4 | | 0.87 | TEPA | 1.59 | 134 | 1.21 | 40.3 |
| 5 | | 0.87 | HPA | 2.07 | 143 | 0.80 | 50.9 |
| 6 | | 0.87 | DETA | 1.07 | 140 | 0.87 | 16.1 |
| 7 | | 0.5 | TETA | 0.78 | 166 | 2.54 | 12.4 |
| 8 | | 0.5 | TEPA | 1.04 | 174 | 2.61 | 17.4 |
| 9 | | 0.5 | HPA | 1.29 | 178 | 2.33 | 30.1 |
| 10 | | 0.5 | DETA | 0.71 | 156 | 4.73 | 6.7 |
| 11 | EC | 0.5 | TETA | 0.81 | 192 | 0.07 | 8.8 |
| 12 | EC | 0.5 | TEPA | 0.94 | 207 | 0 | 11.9 |
| 13 | EC | 0.5 | HPA | 1.21 | 307 | 0.13 | 16.7 |
| 14 | EC | 0.5 | DETA | 0.69 | 161 | 0 | 5.1 |

Examples 15–26

Preparation of 2300 MW Polysuccinimides

The product of Example 2, the 2300 MW mixture of polyPIBSA and thermal PIBSA, was reacted with amines following the general procedure of Example 3. A number of 2300 MW polysuccinimides were produced. These materials are reported in Table 2.

TABLE 2

ANALYSIS OF 2300 MW POLYSUCCINIMIDES PREPARED ACCORDING TO EXAMPLE 3

| Example | Post treat | Amine/PIBSA CMR | Amine | % N | vis @ 100° C., cSt | TBN mg KOH/g |
|---|---|---|---|---|---|---|
| 15 | | 0.87 | DETA | 0.62 | 379 | 8.5 |
| 16 | | 0.87 | TETA | 0.83 | 396 | 19.6 |
| 17 | | 0.87 | TEPA | 0.95 | 428 | 23.5 |
| 18 | | 0.87 | HPA | 1.10 | 496 | 28.6 |
| 19 | | 0.5 | DETA | 0.43 | 392 | 5.7 |
| 20 | | 0.5 | TETA | 0.56 | 443 | 9.0 |
| 21 | | 0.5 | TEPA | 0.58 | 484 | 8.4 |
| 22 | | 0.5 | HPA | 0.89 | 516 | 19.3 |
| 23 | EC | 0.5 | DETA | 0.44 | 466 | 4.2 |
| 24 | EC | 0.5 | TETA | 0.59 | 591 | 6.5 |
| 25 | EC | 0.5 | TEPA | 0.61 | 607 | 7.0 |
| 26 | EC | 0.5 | HPA | 0.89 | 756 | 11.2 |

These examples show the preparation of copolymers with long alkyl tails.

Example 27

Preparation of 1000 MW PolyPIBSA

1000 MW polyPIBSA was synthesized according to the teachings of U.S. Pat. No. 5,112,507. To a 2 liter, three neck flask equipped with a mechanical stirrer, thermometer, and condenser was added 1000 grams of Glissopal 1000 (1 mole). To this was added at 110° C. 19.6 grams maleic anhydride (0.20 mole). The temperature was then increased to 160° C., and then to this was added a total of 59.8 grams maleic anhydride (0.60 mole) and 7.3 grams di-tert-butyl peroxide (0.05 mole) in portions over two hours. The total amount of maleic anhydride added equaled 78.42 grams (0.80 mole). The maleic anhydride/polybutene CMR was 0.8. This was then stirred at 160° C. for five hours. The reaction was then cooled and analyzed. The product was found to contain 62.7% actives, and had a SAP number of 48.9 mg KOH/gram. The calculated succinic ratio was 0.8.

Example 28

Preparation of 2300 MW PolyPIBSA

2300 MW polyPIBSA was prepared according to the procedure of Example 27 except that a temperature of 170° C. was used. Glissopal 2300 polybutene was also used instead of Glissopal 1000. The product that was obtained had a SAP number of 36.8 mg KOH/gram. The percent actives was 80% and the calculated succinic ratio was 1.0.

Example 29

Preparation of 2300 MW PolyPIBSA With Greater Than 1.0 Succinic Ratio

To a 22 liter three neck flask equipped with a mechanical stirrer, reflux condenser and thermometer, was added 15953 grams (6.647 mole) Glissopal 2300. This was heated to 110° C. and to this was added 1303.2 grams maleic anhydride (13.294 mole) with stirring. The maleic anhydride/polybutene CMR was 2.0. The temperature was then increased to 160° C., and to this was added 48.52 grams di-tert-butyl peroxide (0.332 mole) in portions over a five-hour period. Then the reaction was heated at 160° C. for 13 hours. Then the reaction temperature was increased to 190° C. to decompose any remaining peroxide initiator and then excess maleic anhydride was removed in vacuo. The product was then diluted with diluent oil and filtered. The final product had a SAP number of 18.34 and contained about 35% actives. The calculated succinic ratio was 1.13.

These examples show the reaction product of a copolymer with a long alkyl tail, a linear succinic anhydride with a short alkyl tail, and a polyamine.

Example 30

Reaction Product of a 1000 MW Long Tail Copolymer With a Linear $C_{12}$ Succinic Anhydride and a Polyamine To a 500 mL 3 neck flask equipped with a mechanical stirrer, Dean Stark trap, and condenser was added 257.06 grams (0.112 mole) of the reaction product of Example 27 and 31.4 grams of dodecenylsuccinic anhydride (DOSA) (95% actives, 0.112 mole) at a temperature of 100° C. The anhydride ratio of succinic anhydride to copolymer was 1.0. Then to this was added 30.80 grams HPA (0.112 mole) dropwise with stirring. The amine/anhydride CMR was 0.5. The temperature was then increased to 160° C. and held for 5.5 hours. Then the product was cooled. The product was analyzed and found to contain 3.26% N, a TBN of 75 mg KOH/gram, a TAN of 2.87 mg KOH/gram, and a viscosity at 100° C. of 1709 cSt.

Examples 31–35

Preparation of Polysuccinimides From a Long Tail Copolymer, a Short Tail Succinic Anhydride and a Polyamine A number of other polysuccinimides were prepared following the procedure of Example 30. These products, which differed in the nature of the long tail copolymer, are reported in Table 3.

TABLE 3

ANALYTICAL RESULTS FOR THE POLYSUCCINIMIDES PREPARED ACCORDING TO EXAMPLES 30–35

| Example | Copolymer Used | Anhydride Ratio | Amine: Anhydride CMR | Amine | % N | vis @ 100° C., cSt | TAN, mg KOH/g | TBN, mg KOH/g |
|---|---|---|---|---|---|---|---|---|
| 30 | Example 27 | 1.0 | 0.5 | HPA | 3.26 | 1709 | 2.87 | 75.0 |
| 31 | Example 27 | 1.0 | 0.5 | TETA | 2.03 | 1403 | 5.02 | 27.1 |
| 32 | Example 28 | 1.0 | 0.5 | HPA | 2.59 | 3916 | 1.08 | 61.3 |
| 33 | Example 28 | 1.0 | 0.5 | TETA | 1.55 | 5731 | 3.07 | 19.4 |
| 34 | Example 29 | 1.0 | 0.5 | HPA | 1.37 | 241 | 0.84 | 28.9 |
| 35 | Exampie 29 | 1.0 | 0.5 | TETA | 0.85 | 240 | 1.90 | 10.2 |

The next examples show the ethylene carbonate post treatment reaction of a polysuccinimide made from a copolymer with a long alkyl tail, a linear succinic anhydride with a short alkyl tail, and a polyamine.

Examples 36–41

Ethylene Carbonate Post Treatment Reaction Products

The polysuccinimides of Examples 30–35 were reacted with ethylene carbonate according to the procedure of Example 11. These products are reported in Table 4.

TABLE 4

ETHYLENE CARBONATE POST TREATED POLYSUCCINIMIDES

| Example | Poly-succinmide Used | EC/BN CMR | Amine: Anhydride CMR | Amine | % N | vis @ 100° C., cSt | TAN, mg KOH/g | TBN, mg KOH/g |
|---|---|---|---|---|---|---|---|---|
| 36 | Example 30 | 2.0 | 0.5 | HPA | 2.90 | 2415 | 0.07 | 37.4 |
| 37 | Example 31 | 2.0 | 0.5 | TETA | 1.96 | 1333 | 0.05 | 15.8 |
| 38 | Example 32 | 2.0 | 0.5 | HPA | 2.34 | 8049 | 0.06 | 32.0 |
| 39 | Example 33 | 2.0 | 0.5 | TETA | 1.53 | 4617 | 0.08 | 14.3 |
| 40 | Exampie 34 | 2.0 | 0.5 | HPA | 1.34 | 492 | 0.06 | 18.2 |
| 41 | Example 35 | 2.0 | 0.5 | TETA | 0.84 | 236 | 0.06 | 8.0 |

The next examples show the reaction product of a copolymer with a long alkyl tail, a branched succinic anhydride with a short alkyl tail, and a polyamine.

Examples 42–45

Reaction Products Using a Branched Succinic Anhydride

The procedure of Examples 30–35 was followed exactly except that the branched tetrapropenylsuccinic anhydride (TPSA) was used instead of the linear DOSA. These products are reported in Table 5. The post treatment procedure of Example 11 was also carried out, and these products are reported in Table 5.

TABLE 5

ANALYTICAL RESULTS FOR THE BRANCHED TPSA SUCCINIC ANHYDRIDE

| Example | Copolymer Used | Anhydride Ratio | EC/BN CMR | Amine: Anhydride CMR | Amine | % N | vis @ 100° C., cSt | TAN, mg KOH/g | TBN, mg KOH/g |
|---|---|---|---|---|---|---|---|---|---|
| 42 | Example 29 | 1.0 | 0 | 0.5 | HPA | 1.41 | 247 | 0.88 | 27.1 |
| 43 | Example 29 | 1.0 | 2.0 | 0.5 | HPA | 1.37 | 486 | — | 17.3 |
| 44 | Example 29 | 1.0 | 0 | 0.5 | TETA | 0.88 | 246 | 2.59 | 10.6 |
| 45 | Example 29 | 1.0 | 2.0 | 0.5 | TETA | 0.90 | 274 | — | 7.1 |

Soot Thickening Bench Test

The $C_{12}$ end capped polysuccinimides of the present invention were tested in the soot thickening bench test. This gives an indication of the performance of these polysuccinimides. The details of this test are reported in U.S. Pat. No. 5,716,912. The % viscosity increase, as measured in the soot thickening bench test, is reported in Table 6.

TABLE 6

BENCH TEST RESULTS FOR THE $C_{12}$ END CAPPED POLYSUCCINIMIDES

| Example | Amine | PIB MW | $C_{12}$ Succ. Anhydride | EC/BN CMR | A/P CMR | % Actives | Soot Thickening % Vis. Incr. |
|---|---|---|---|---|---|---|---|
| 30 | HPA | 1000 | Linear | 0 | 0.5 | 62.7 | 228 |
| 36 | HPA | 1000 | Linear | 2.0 | 0.5 | 62.7 | 396 |
| 31 | TETA | 1000 | Linear | 0 | 0.5 | 62.7 | 467 |
| 37 | TETA | 1000 | Linear | 2.0 | 0.5 | 62.7 | 412 |
| 32 | HPA | 2300 | Linear | 0 | 0.5 | 50 | 170 |
| 38 | HPA | 2300 | Linear | 2.0 | 0.5 | 50 | 26 |
| 33 | TETA | 2300 | Linear | 0 | 0.5 | 50 | 464 |
| 39 | TETA | 2300 | Linear | 2.0 | 0.5 | 50 | 62 |
| 34 | HPA | 2300 | Linear | 0 | 0.5 | 35 | 54 |
| 40 | HPA | 2300 | Linear | 2.0 | 0.5 | 35 | 23 |
| 35 | TETA | 2300 | Linear | 0 | 0.5 | 35 | 112 |
| 41 | TETA | 2300 | Linear | 2.0 | 0.5 | 35 | 50 |
| 42 | HPA | 2300 | Branched | 0 | 0.5 | 35 | 200 |
| 43 | HPA | 2300 | Branched | 2.0 | 0.5 | 35 | 22 |
| 44 | TETA | 2300 | Branched | 0 | 0.5 | 35 | 301 |
| 45 | TETA | 2300 | Branched | 2.0 | 0.5 | 35 | 64 |

In the soot thickening bench test, better results are obtained from those samples which gave lower % viscosity increase. These results show that in the soot thickening bench test, the polysuccinimides made from the 1000 molecular weight polybutene tails gave inferior performance compared to the polysuccinimides made from the 2300 molecular weight polybutene tails. Little if any difference in performance was observed between the samples prepared from the linear or branched $C_{12}$ succinic anhydride.

TABLE 7

BENCH TEST RESULTS FOR THE POLYSUCCINIMIDES WITH A LONG TAIL SUCCINIC ANHYDRIDE

| Example | Amine | PIB MW | EC/BN CMR | A/P CMR | % Actives | Soot Thickening % Vis. Incr. |
|---|---|---|---|---|---|---|
| 3 | TETA | 1300 | 0 | 0.87 | 40 | 277 |
| 4 | TEPA | 1300 | 0 | 0.87 | 40 | 177 |
| 5 | HPA | 1300 | 0 | 0.87 | 40 | 80 |
| 6 | DETA | 1300 | 0 | 0.87 | 40 | 301 |
| 7 | TETA | 1300 | 0 | 0.5 | 40 | 276 |
| 8 | TEPA | 1300 | 0 | 0.5 | 40 | 134 |

TABLE 7-continued

BENCH TEST RESULTS FOR THE POLYSUCCINIMIDES WITH A LONG TAIL SUCCINIC ANHYDRIDE

| Example | Amine | PIB MW | EC/BN CMR | A/P CMR | % Actives | Soot Thickening % Vis. Incr. |
|---|---|---|---|---|---|---|
| 9 | HPA | 1300 | 0 | 0.5 | 40 | 102 |
| 10 | DETA | 1300 | 0 | 0.5 | 40 | 360 |
| 11 | TETA | 1300 | 2 | 0.5 | 40 | 67 |
| 12 | TEPA | 1300 | 2 | 0.5 | 40 | 62 |
| 13 | HPA | 1300 | 2 | 0.5 | 40 | 35 |
| 14 | DETA | 1300 | 2 | 0.5 | 40 | 258 |
| 15 | DETA | 2300 | 0 | 0.87 | 40 | 318 |
| 16 | TETA | 2300 | 0 | 0.87 | 40 | 387 |
| 17 | TEPA | 2300 | 0 | 0.87 | 40 | 355 |
| 18 | HPA | 2300 | 0 | 0.87 | 40 | 197 |
| 19 | DETA | 2300 | 0 | 0.5 | 40 | 341 |
| 20 | TETA | 2300 | 0 | 0.5 | 40 | 321 |
| 21 | TEPA | 2300 | 0 | 0.5 | 40 | 386 |
| 22 | HPA | 2300 | 0 | 0.5 | 40 | 137 |
| 23 | DETA | 2306 | 2 | 0.5 | 40 | 335 |
| 24 | TETA | 2300 | 2 | 0.5 | 40 | 340 |

TABLE 7-continued

BENCH TEST RESULTS FOR THE POLYSUCCINIMIDES WITH A LONG TAIL SUCCINIC ANHYDRIDE

| Example | Amine | PIB MW | EC/BN CMR | A/P CMR | % Actives | Soot Thickening % Vis. Incr. |
|---|---|---|---|---|---|---|
| 25 | TEPA | 2300 | 2 | 0.5 | 40 | — |
| 26 | HPA | 2300 | 2 | 0.5 | 40 | 34 |

Viton Seal Swell Bench Test

The polysuccinimides of the present invention were tested in the Volkswagen Viton seal swell bench test. This test measures the tensile strength, elongation, and cracks performance of lubricating oils. The details of this test are reported in U.S. Pat. No. 5,062,980. The results of the Viton test are reported in Table 8. of 0.5 perform better than polysuccinimides with an amine/PIBSA CMR of 0.87. In addition, polysuccinimides that used DETA, TETA, and TEPA as the amine gave better performance than polysuccinimides that used HPA as the amine.

TABLE 8

VITON TEST RESULTS FOR THE POLYSUCCINIMIDES WITH A LONG TAIL SUCCINIC ANHYDRIDE

| Example | Amine | PIB MW | EC/BN CMR | A/P CMR | % Actives | Tensile Strength | Elongation | Cracks |
|---|---|---|---|---|---|---|---|---|
| 3 | TETA | 1300 | 0 | 0.87 | 40 | −39 | −34 | Y |
| 4 | TEPA | 1300 | 0 | 0.87 | 40 | −40 | −36 | Y |
| 5 | HPA | 1300 | 0 | 0.87 | 40 | −38 | −33 | Y |
| 6 | DETA | 1300 | 0 | 0.87 | 40 | −28 | −27 | N |
| 7 | TETA | 1300 | 0 | 0.5 | 40 | −2 | −8 | N |
| 8 | TEPA | 1300 | 0 | 0.5 | 40 | −13 | −17 | N |
| 9 | HPA | 1300 | 0 | 0.5 | 40 | −29 | −26 | N |
| 10 | DETA | 1300 | 0 | 0.5 | 40 | +4 | −3 | N |
| 11 | TETA | 1300 | 2 | 0.5 | 40 | +7 | −7 | N |
| 12 | TEPA | 1300 | 2 | 0.5 | 40 | −5 | −6 | N |
| 13 | HPA | 1300 | 2 | 0.5 | 40 | −21 | −9 | N |
| 14 | DETA | 1300 | 2 | 0.5 | 40 | +7 | −26 | N |
| 15 | DETA | 2300 | 0 | 0.87 | 40 | −22 | −26 | N |
| 16 | TETA | 2300 | 0 | 0.87 | 40 | −30 | −31 | Y |
| 17 | TEPA | 2300 | 0 | 0.87 | 40 | −29 | −30 | Y |
| 18 | HPA | 2300 | 0 | 0.87 | 40 | −33 | −28 | N |
| 19 | DETA | 2300 | 0 | 0.5 | 40 | +2 | −3 | N |
| 20 | TETA | 2300 | 0 | 0.5 | 40 | +4 | −3 | N |
| 21 | TEPA | 2300 | 0 | 0.5 | 40 | −5 | −8 | N |
| 22 | HPA | 2300 | 0 | 0.5 | 40 | −19 | −24 | N |
| 23 | DETA | 2300 | 2 | 0.5 | 40 | +7 | −10 | N |
| 24 | TETA | 2300 | 2 | 0.5 | 40 | +2 | −8 | N |
| 25 | TEPA | 2300 | 2 | 0.5 | 40 | −9 | −8 | N |
| 26 | HPA | 2300 | 2 | 0.5 | 40 | −19 | −25 | N |

While the present invention has been described with reference to specific embodiments, this application is intended to cover those various changes and substitutions that may be made by those skilled in the art without departing from the spirit and scope of the appended claims.

What is claimed is:

1. A process for preparing a polysuccinimide which comprises reacting a mixture under reactive conditions, wherein the mixture comprises:

(a) an alkenyl or alkylsuccinic acid derivative, wherein the alkenyl or alkyl substituent has a Mn of from 140 to 3000;

(b) an unsaturated acidic reagent copolymer of (1) an unsaturated acidic reagent and (2) an olefin having a Mn of at least 1000, wherein the copolymer has an average degree of polymerization of from 2 to 20; and (c) a polyamine having at least three nitrogen atoms and 4 to 20 carbon atoms.

2. A process for preparing a polysuccinimide according to claim 1 wherein said olefin has a Mn from 1800 to 3000.

3. A process for preparing a polysuccinimide according to claim 1 wherein said mixture contains from 1.5 to 10 equivalents of said alkenyl or alkylsuccinic acid derivative per equivalent of said unsaturated acidic reagent copolymer and from 0.4 to 1.0 equivalents of said polyamine per equivalent of the sum of alkenyl or alkylsuccinic acid derivative and unsaturated acidic reagent copolymer.

4. A process for preparing a polysuccinimide according to claim 1 wherein the alkenyl or alkyl substituent of the alkenyl or alkylsuccinic acid derivative has a Mn of from 140 to 420.

5. A polysuccinimide composition prepared by reacting a mixture under reactive conditions, wherein the mixture comprises:

(a) an alkenyl or alkylsuccinic acid derivative, wherein the alkenyl or alkyl substituent has a Mn of from 140 to 3000;

(b) an unsaturated acidic reagent copolymer of (1) an unsaturated acidic reagent and (2) an olefin having a Mn of at least 1000, wherein the copolymer has an average degree of polymerization of from 2 to 20; and (c) a polyamine having at least three nitrogen atoms and 4 to 20 carbon atoms.

6. A polysuccinimide composition according to claim 5 wherein said olefin has a molecular weight of from 1800 to 3000, and wherein said mixture contains from 1.5 to 10 equivalents of said alkenyl or alkylsuccinic acid derivative per equivalent of said unsaturated acidic reagent copolymer and from 0.4 to 1.0 equivalents of said polyamine per equivalent of the sum of alkenyl or alkylsuccinic acid derivative and unsaturated acidic reagent copolymer.

7. A polysuccinimide composition according to claim 5 wherein the alkenyl or alkyl substituent of the alkenyl or alkylsuccinic acid derivative has a Mn of from 140 to 420.

8. A polysuccinimide composition according to claim 5 wherein the polyamine has from 6 to 10 nitrogen atoms.

9. A concentrate comprising from 20% to 60% of the polysuccinimide composition of claim 5 and from 80% to 40% of an organic diluent.

10. A lubricating oil composition comprising a major amount of an oil of lubricating viscosity and a minor amount of the polysuccinimide composition of claim 5.

11. A post-treated polysuccinimide composition prepared by treating the polysuccinimide composition of claim 5 with a cyclic carbonate or a linear mono- or poly-carbonate under reactive conditions.

12. The post-treated polysuccinimide composition of claim 11 wherein said cyclic carbonate is ethylene carbonate.

13. A lubricating oil composition comprising a major amount of an oil of lubricating viscosity and a minor amount of the post-treated polysuccinimide composition of claim 11.

14. A concentrate comprising from 20% to 60% of the post-treated polysuccinimide composition of claim 11 and from 80% to 40% of an organic diluent.

15. A post-treated polysuccinimide composition prepared by treating the polysuccinimide composition of claim 5 under reactive conditions with a boron compound selected from the group consisting of boron oxide, boron halide, boric acid, and esters of boric acid.

16. A polysuccinimide having the formula:

(I)

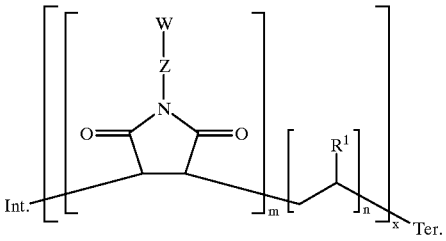

wherein:

W is a nitrogen-containing group which is a mixture of

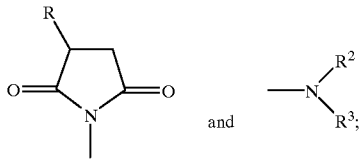

R is a polyalkyl or polyalkylene having a number average molecular weight of about 140 to 3000;

$R^1$ is an alkyl having a number average molecular weight of at least 1000;

Z is a polyalkylene polyamine linking radical;

m is a whole integer of from 1 to 3;

n is a whole integer of from 1 to 3;

x is a whole integer of from 2 to 20;

Int. is an initiating radical;

Ter. is a terminating group; and wherein $R^2$ and $R^3$ are independently hydrogen, alkyl, phenyl, or taken together are alkylene to give a ring group.

17. A polysuccinimide according to claim 16 wherein R is an alkyl having a number average molecular weight of from 140 to 420.

18. A polysuccinimide according to claim 16 wherein $R^1$ is an alkyl having a number average molecular weight of from 1800 to 3000.

* * * * *